US005568664A

United States Patent [19]

Lin

[11] Patent Number: 5,568,664

[45] Date of Patent: Oct. 29, 1996

[54] MODULAR PAD ASSEMBLY

[75] Inventor: Huei-Kan Lin, Taipei Hsien, Taiwan

[73] Assignee: Young Band Co., Ltd., Tu-Cheng, Taiwan

[21] Appl. No.: 284,317

[22] Filed: Aug. 1, 1994

[51] Int. Cl.[6] ..... A47C 20/02

[52] U.S. Cl. ..... 5/652; 5/722

[58] Field of Search ..... 5/465, 461, 476, 5/481, 652, 653, 657; 601/71, 79, 56, 57, 49, 74

[56] References Cited

U.S. PATENT DOCUMENTS

| | | | |
|---|---|---|---|
| 3,808,616 | 5/1974 | White | 5/465 X |
| 3,877,750 | 4/1975 | Scholpp | 5/652 X |
| 4,459,714 | 7/1984 | Lin | 5/465 X |
| 4,518,203 | 5/1985 | White | 5/465 X |
| 4,603,444 | 8/1986 | Suits | 5/657 |
| 4,948,311 | 3/1991 | Ernst | 5/465 X |
| 5,086,529 | 2/1992 | DeGroot | 5/465 |
| 5,327,598 | 7/1994 | Liou | 5/481 |
| 5,437,607 | 8/1995 | Taylor | 601/57 X |
| 5,437,608 | 8/1995 | Cutler | 601/57 X |
| 5,443,532 | 8/1995 | Hudak | 5/652 |

*Primary Examiner*—Steven N. Meyers
*Assistant Examiner*—Monica E. Millner
*Attorney, Agent, or Firm*—Skjerven, Morrill, MacPherson, Franklin & Friel; Alan H. MacPherson; Thomas S. MacDonald

[57] ABSTRACT

A modular pad assembly includes at least two elongated plate members. Each of the elongated plate member has two opposed ends, and upper and lower faces. Each of the lower faces of the elongated plate members has two longitudinally spaced retaining rings formed thereon. The axes of the two retaining rings are aligned with one another and are parallel to a longitudinal axis of one of the elongated plate members. Each of the retaining rings of the elongated plate has an L-shaped support rod mounted rotatably thereto. Each of the L-shaped support rods has a first arm which is journalled to one of the retaining rings and a second arm which is connected perpendicularly to the first arm. Each of the second arms of the L-shaped support rods has a free end which is formed with a connecting loop. Each of the connecting loops of the L-shaped support rods has an axis transverse to the longitudinal axis of one of the elongated plates.

7 Claims, 12 Drawing Sheets

MODULAR PAD ASSEMBLY

BACKGROUND OF THE INVENTION

1. Field of the Invention

This invention relates to a pad, more particularly to a modular pad assembly which conforms to the ergonomic requirements so as to provide comfort to the user.

2. Description of the Related Art

Most people spend long hours sitting in their offices or in their cars while at work. Other people who have serious illness are bedridden for an indefinite period of time. Such prolonged sitting in chair or prolonged lying on bed are usually the causes of backache, shoulderache, decubitus or more serious problems. Generally, the ordinary chair or bed is not designed to body when the former is in user.

To overcome the above-mentioned disadvantages of common chairs and beds, several types of chairs and beds have been developed so as to conform to the shape of the human body. However, the sizes of chairs and beds are based on the average size of individuals. Thus, such chairs and beds are not suitable for everyone's use. In addition, these specially designed chairs and beds are expensive and are not widely used. Further, soft cushions are usually installed to enhance the user's comfort. However, because such soft cushions are not air permeable, the user may have skin problems, or develop a deformed spine.

In addition, magnetic vibrating belts or massage units are usually placed on a chair or bed in order to massage a user who is sitting or lying thereon. Such a magnetic vibrating belt or a massage unit has a plurality of magnets disposed therein and wires for connecting electrically the magnets to a power supply so as to actuate the magnets to vibrate and effect massaging of the user. However, the structures of the chair and bed cannot provide comfort to a user who sits or lies on the chair or bed after a period of time.

SUMMARY OF THE INVENTION

Therefore, the main object of this invention is to provide a modular pad assembly ergonomically designed to be which suits the design needs of ergonomics and any body shape, which allows the user to experience the most comfortable and suitable posture and position while sitting or lying thereon, and which allows air to circulate, thereby providing better ventilation.

Another object of this invention is to provide a modular pad assembly which is suitable for use with a magnet vibrating belt or massage unit to be disposed between the human body and the normal chair or bed.

According to the present invention, a modular pad assembly includes at least two elongated plate members. Each of the elongated plate members has two opposed ends, and upper and lower faces. The lower face of each of the elongated plate members has two longitudinally spaced retaining rings formed thereon. The axes of the two retaining rings are aligned with one another and are parallel to the longitudinal axis of their respective one of the elongated plate member. Each of the retaining rings of the elongated plate members has an L-shaped support rod mounted rotatably thereto. Each of the L-shaped support rods has a first arm which is journalled to the respective one of the retaining rings and a second arm which is connected perpendicularly to the first arm. The second arm of each L-shaped support rod has a free end which is formed with a connecting loop. Each of the connecting loops of the L-shaped support rods has an axis transverse to the longitudinal axis of the respective one of the elongated plates. The axes of the connecting loops adjacent to ones of the opposed ends of the elongated plate members are aligned with one another to form a first common axis, while the axes of the connecting loops adjacent to the other ones of the opposed ends of the elongated plate members are aligned with one another to form a second common axis. The first and second common axes are on a first plane which are parallel to a second plane which is defined by the respective one of the elongated plates. Each of the L-shaped support rods has two positioning members connected near both sides of the respective one of the retaining rings to prevent the first arms of the L-shaped arms from being disengaged from the retaining rings. Each of the elongated plate members has a pair of coupling members interconnecting the connecting loops along the first and second common axes, respectively.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

The embodiments of this invention will now be described with reference to the accompanying drawings.

Figure 1:
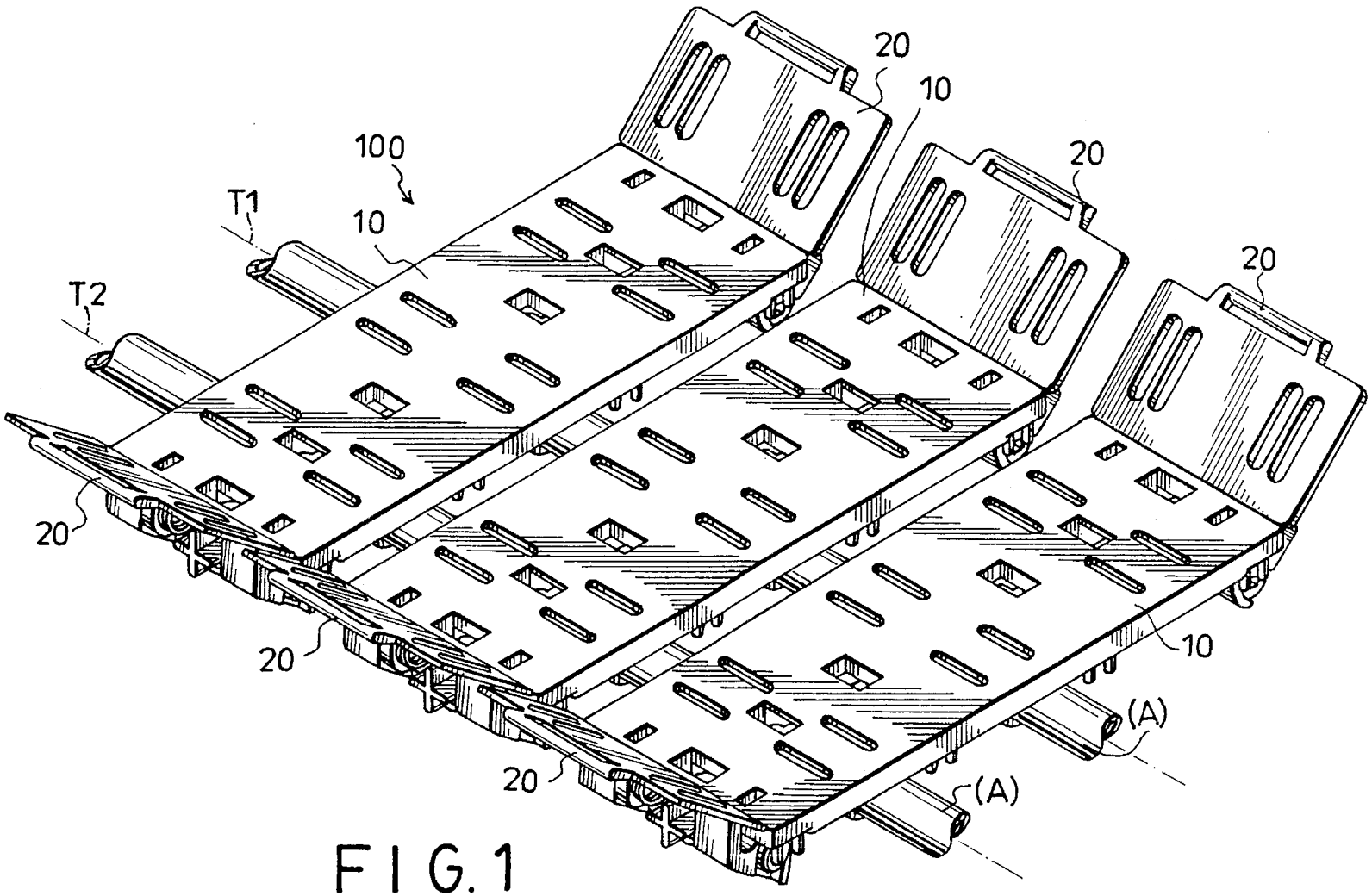
FIG. 1 is a perspective view showing the elongated plate members of a modular pad assembly according to a first embodiment of the present invention.

Referring to FIG. 1, a modular pad assembly 100 according to a first embodiment of this invention includes at least two elongated plate members 10 and a pair of coupling members (A). There are three plate members 10 in this embodiment.

Figure 2:
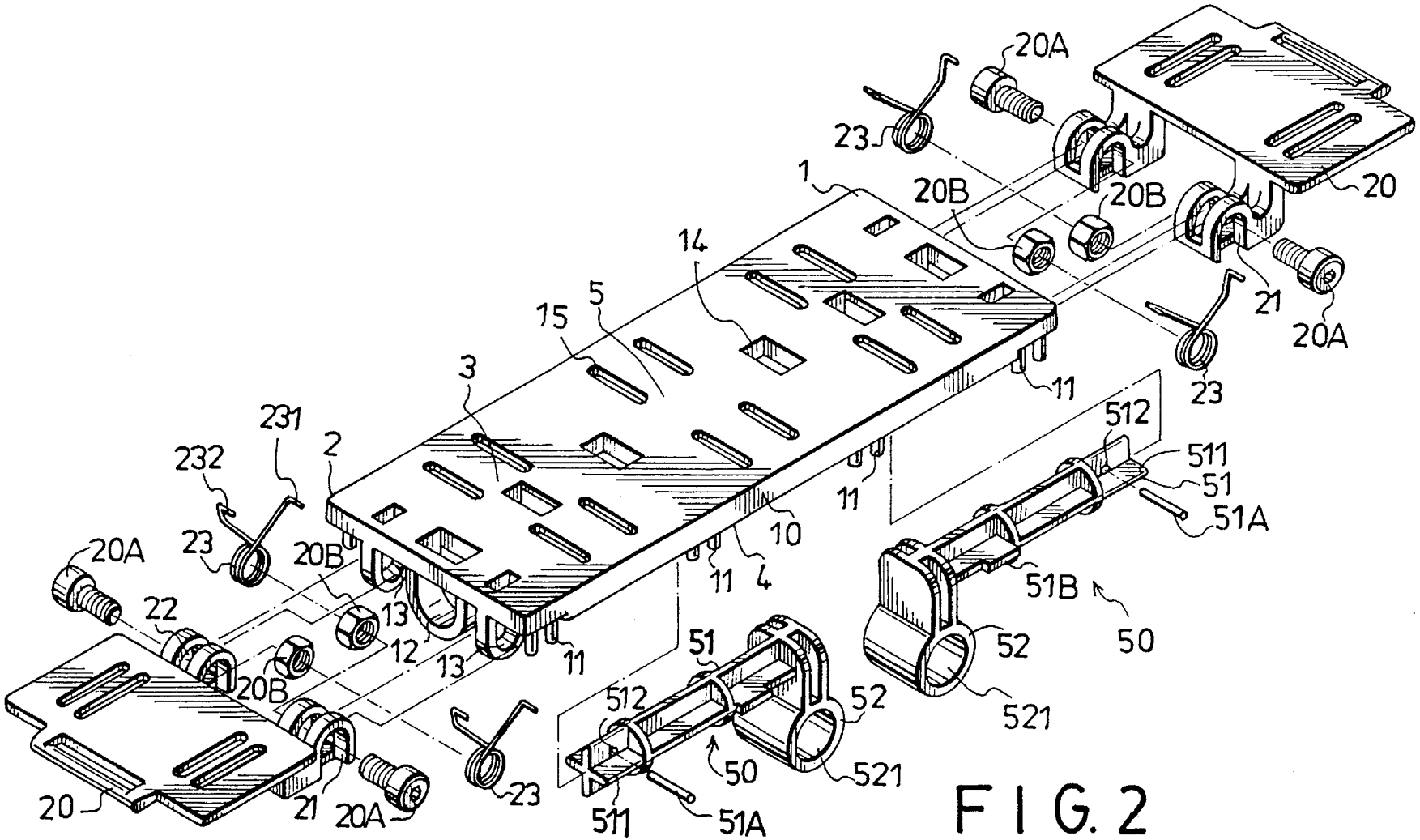
FIG. 2 is an exploded perspective view showing an elongated plate member of the modular pad assembly according to the first embodiment of the present invention.
Figure 3:
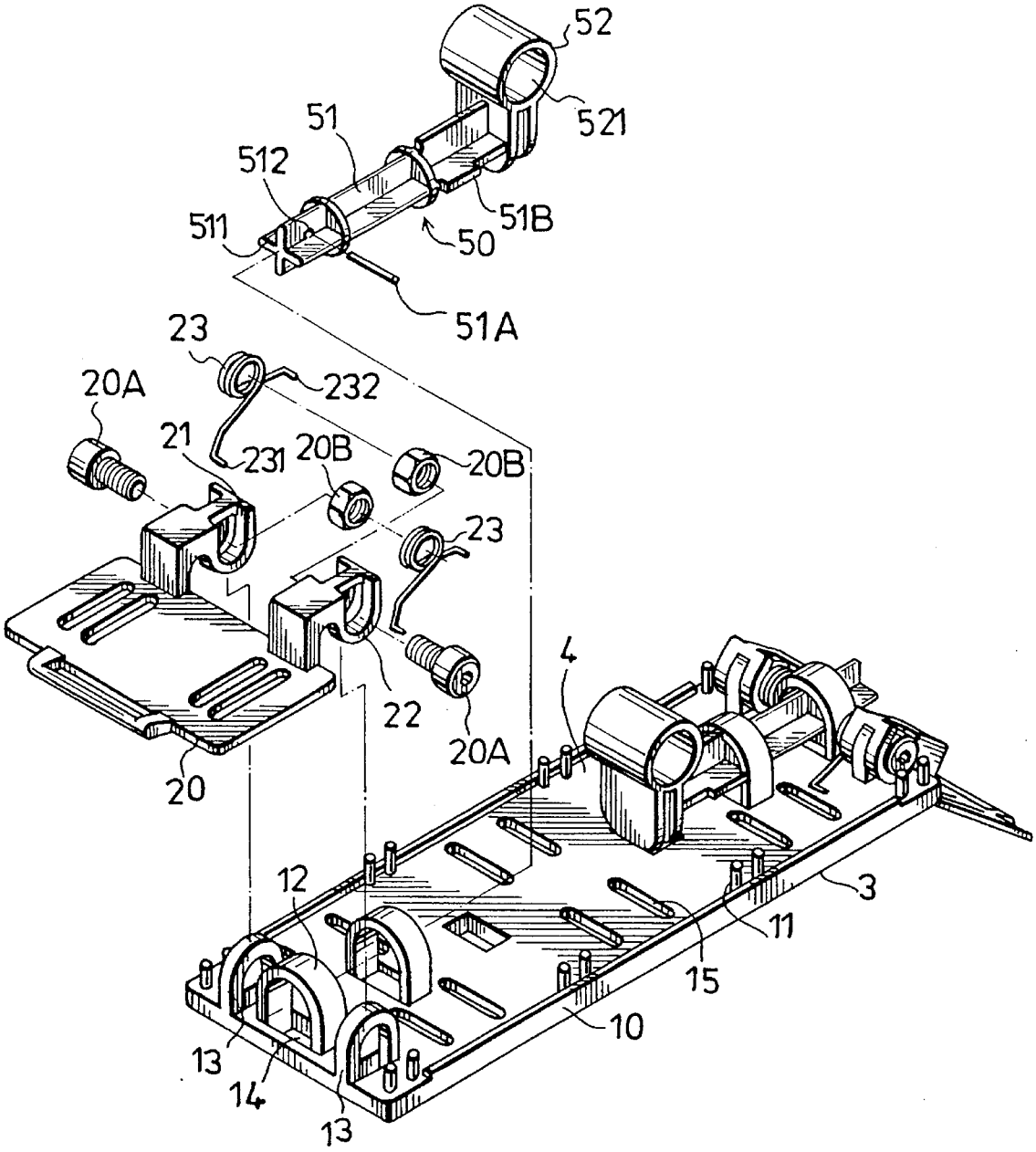
FIG. 3 is an inverted exploded perspective view showing an elongated plate member of the modular pad assembly according to the first embodiment of the present invention.

As illustrated in FIG. 2, each of the elongated plate members 10 has two opposed ends 1, 2, and upper and lower faces 3, 4. The lower face 4 of each elongated plate member 10 has two pairs of longitudinally spaced retaining rings 12, 12' formed respectively on the opposed ends 1, 2 of the plate member 10, as best illustrated in FIG. 3. The axes of the pairs of retaining rings 12, 12' are aligned with one another and are parallel with the longitudinal axis of the elongated plate member 10. Each of the pairs of the retaining rings 12, 12' has a L-shaped support rod 50 connected thereto. Each of the L-shaped support rods 50 has a first arm 51 which is journalled to a selected pair of retaining rings 12 and a second arm 52 which is connected perpendicularly to the first arm 51. The second arm 52 of each L-shaped support rod 50 has a free end which is formed with a connecting loop 521. The connecting loop 521 of each the L-shaped support rod 50 has an axis transverse to the longitudinal axis of the elongated plates 10. The connecting loop 521 of the L-shaped support rods 50 are located at the middle portion 5 of the elongated plate member 10. Therefore, the plate members 10 can be rotated about the L-shaped support rods 50. Pegs 11 are positioned equidistantly on the opposed ends 1, 2 of each the elongated plate member 10. The purpose of the pegs 11 will be described in greater detail in the succeeding paragraphs.

Referring to FIG. 2, the first arm 51 of each of the L-shaped support rods 50 has two positioning members (51A, 51B) formed thereon. One of the positioning members (51A) is a pin which passes transversely through a hole 112 which is formed in each of the free ends 511 of the first arms 51. The other one of the positioning members (51B) is a projecting portion which extends from the middle of the first arm 51. Each of the pair of retaining rings 12, 12' has a first ring 121 adjacent to the one of ends 1 and 2 and a second ring 122 away from the ends 1, 2. One of the pins (51A) abuts against one of the first rings 121 and the protruding portion (51B) adjacent to one of the second rings 122. Therefore, the first and second rings 121 and 122 of the retaining rings 12 and 12' are positioned between the positioning members (51A, 51B) to prevent one of the first arms 51 from disengaging one of the pairs of retaining rings 12, 12'. The elongated plate member 10 has a plurality of slots 15 disposed therein for air circulation which consequently provides better ventilation.

Referring to FIG. 1, the pair of coupling members are two connecting rods (A) according to the first embodiment of the present invention. The axes of the connecting loops 521 adjacent one of the opposed ends 1 and 2 of the elongated plate members 10 are aligned with one another to form a first common axis (T1) while the axes of the connecting loops 521 adjacent the other opposed ends 1 and 2 of the elongated plate members 10 are aligned with one another to form a second common axis (T2). The first and second common axes (T1, T2) are on a first plane and are parallel to a second plane which is defined by one of the elongated plates 10. The connecting rods (A) of the coupling members pass through the connecting loops 521 along the first and second common axis (T1, T2) respectively and connect the plate members 10 together to form the modular pad assembly 100. The friction between the connecting loops 521 of the support rods 50 and the connecting rods allows the elongated plate members 10 to be equidistantly spaced. A plurality of spacers can be also placed on the connecting rods (A) in order to separate the plate members 10. The plate members 10 are rotatable about the L-shaped support rods 50, but the connecting rods (A) limit the range of the rotation of the plate members 10. Therefore, each of the plate members 10 is rotated within a limited angle. The plate members 10 of the modular pad assembly 100 form a plane for bearing a user's body. The plate members 10 can be rotated individually to conform any user's body shape on the modular pad assembly 100 because the plate members 10 divides the outline of the user's body into several sections to enable fine adjustment of the pad assembly on which the user is to lie or sit.

As illustrated in FIG. 3, two pairs of engaging rings 13 are respectively connected to the opposed ends 1 and 2 of the elongated plate member 10. Each of the opposed ends 1 and 2 of the plate members 10 has a rectangular flap 20 hinged thereto. Each of one end of the flaps 20 has two protruding rings 21 and 22 secured thereto. The engaging rings 13 of the flaps 20 are connected to the engaging rings 13 of the plate member 10 by means of a pair of bolts (20A) and nuts (20B) in such a manner as to permit the flaps 20 to rotate relative to the plate member 10 about the bolts (20A). Each of the bolts (20A) is provided with a torsion spring (23A) which has one end portion 231 abutting the lower face 4 of the plate member 10 and another end portion 232 abutting the bottom side of the flap 20. Therefore, the flaps 20 can be rotated at an angle relative to the plate member 20. In use, the flaps 20 can be depressed down against the spring force of the torsion springs 23 until the flaps 20 are on the same plane with the plate member 10 so that the area for bearing the user's body is increased.

Figure 5:
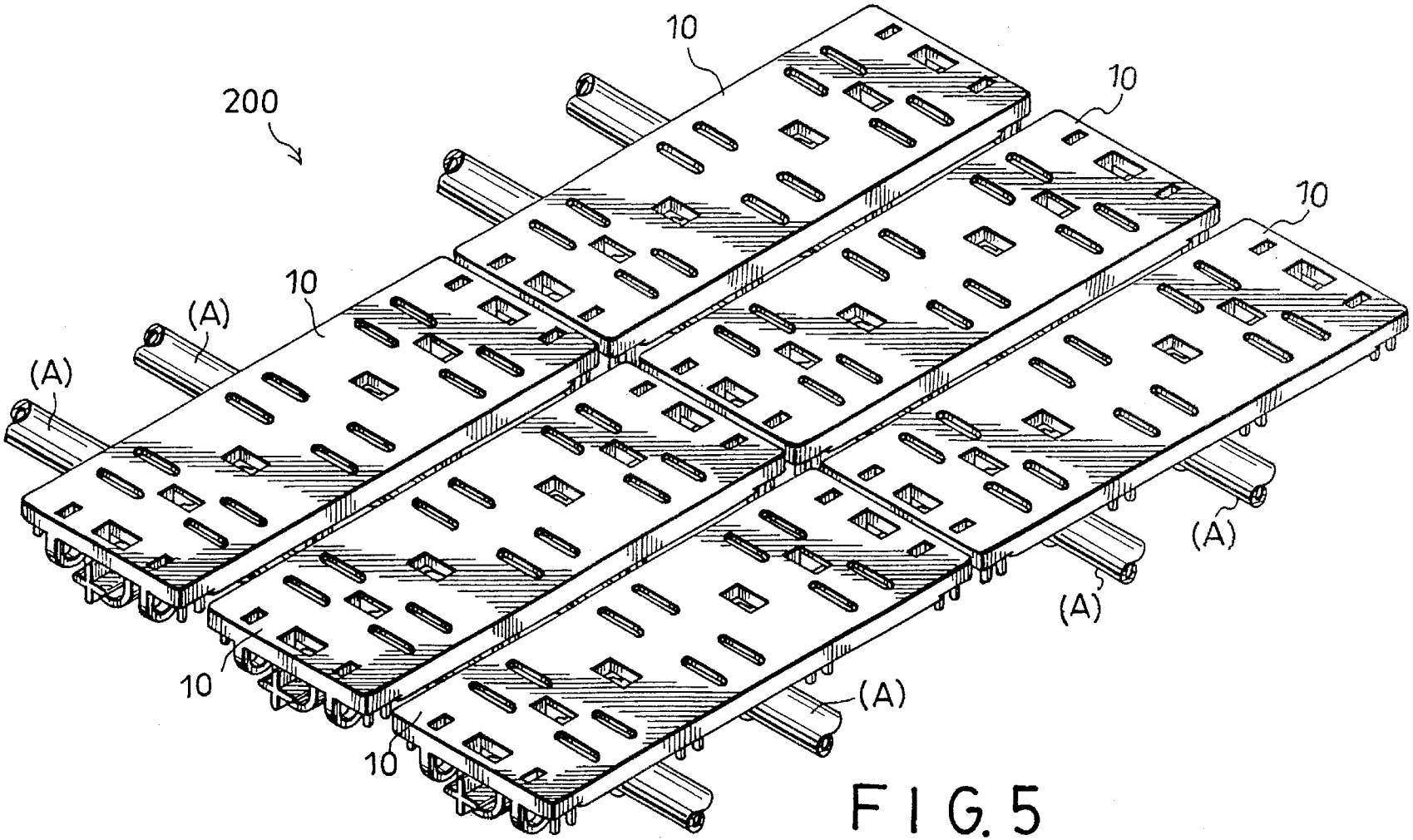
FIG. 5 is a perspective view showing two sets of the modular pad assemblies depending on one another in accordance with the first embodiment of the present invention.

The flaps 20 are detachable from the plate member 10 and can be used as shown in FIG. 5. Two sets of the modular pad assemblies 100 showing in FIG. 1, with the flaps 20 detached from the plate members 10, are connected to one another with the end 1 of one of the sets of the modular pad assemblies 100 abutting against the end 2 of the other set of the modular pad assemblies 100. Thus, the area to be used by the user according to his needs of the user can be increased by combining two or more sets of the modular pad assemblies 100 in a similar manner as described above.

Figure 6:
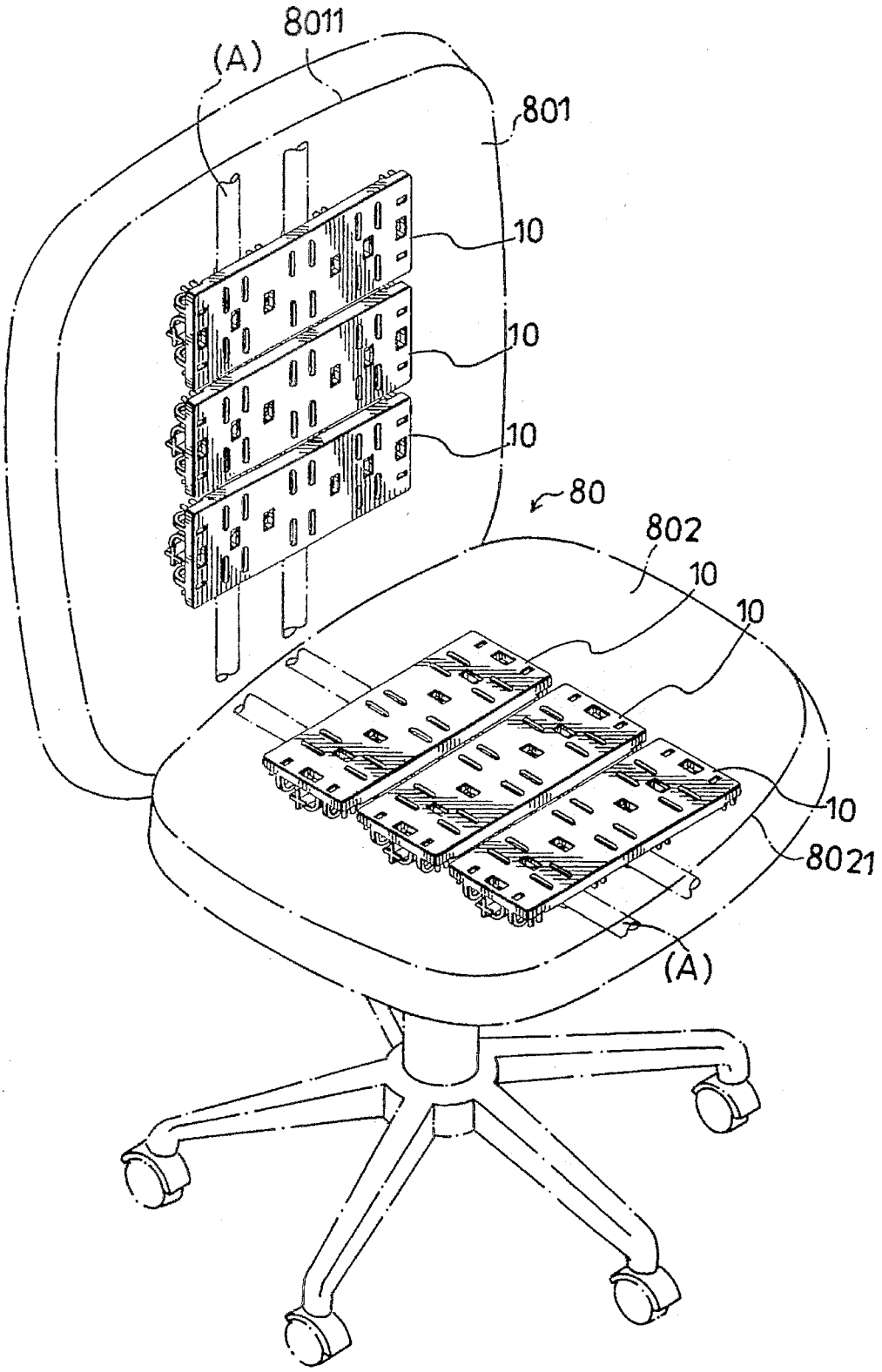
FIG. 6 is a perspective view showing the modular pad assemblies according to the first embodiment of the present invention when used in a chair.

Two sets of the modular pad assemblies 100 of the preferred embodiment of this invention, as shown in FIG. 5, can be mounted in a chair 80, as best shown in FIG. 6. One set of the modular pad assemblies 100 is mounted in the seat back 801 of the chair 80 and the other set of modular pad assemblies 100 is mounted in the seat 802 of the chair 80. The ends of the connecting rods (A) of the two sets of the modular pad assemblies 100 are fixed to the peripheral frames 8011, 8021 of the seat back 801 and the seat 802 of the chair 80. The two sets of modular pad assemblies 100 are nested inside the upholsteries of the seat back 801 and the seat 802 of the chair 80 when the chair 80 is manufactured. As a result, the chair 80 that is not designed to comfort the outline of the user's body is provided with effect on an improved ergonomic design by the use of the modular pad assembly 100 of this invention. It is noted that the plate members 10 of the modular pad assembly 100 of this invention can be individually rotated to conform to the different body outlines of users rather than to conform only to a single outline as is possible in the prior art.

Figure 4:
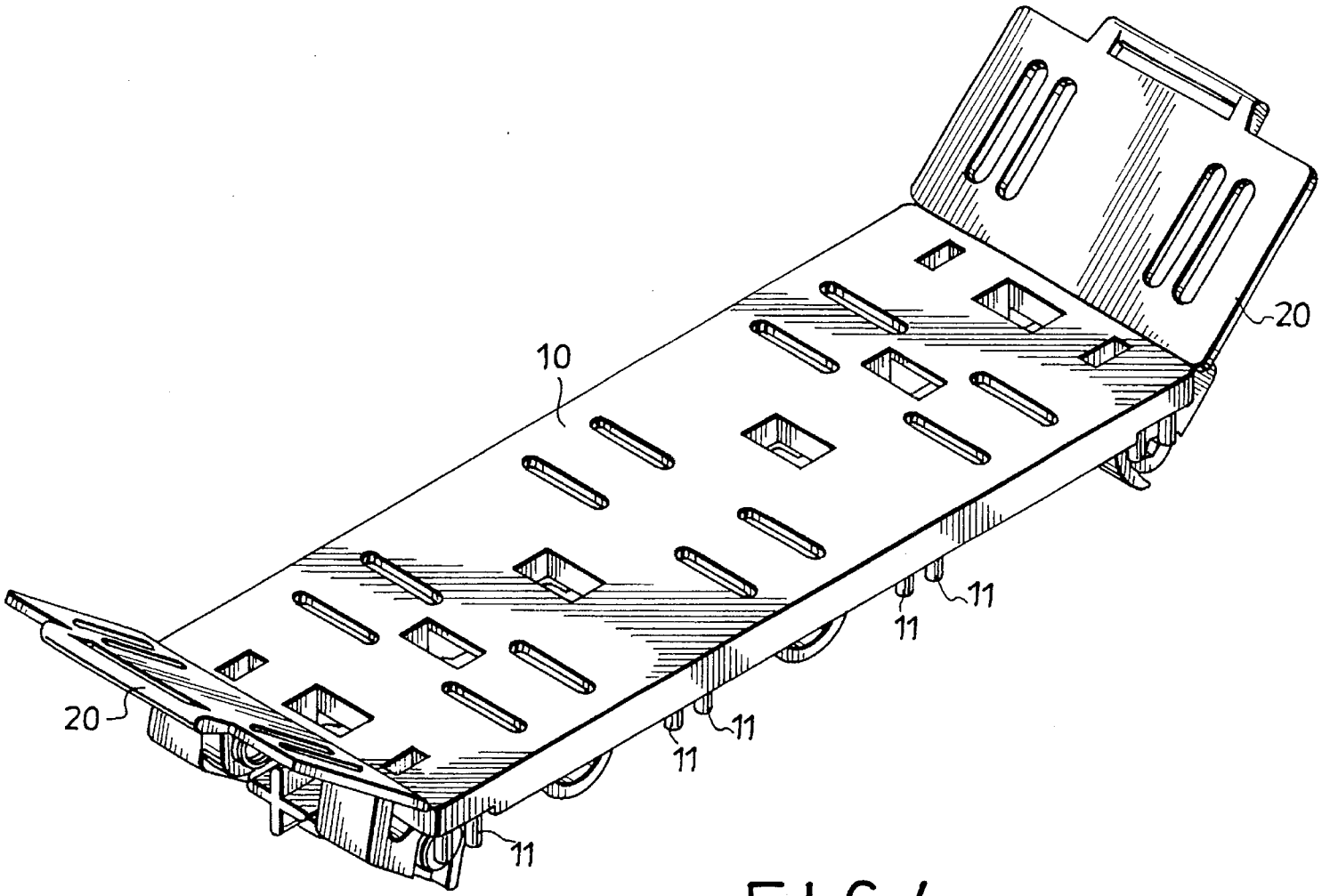
FIG. 4 is a perspective view illustrating the elongated plate member of the modular pad assembly according to the first embodiment of the present invention.
Figure 7:
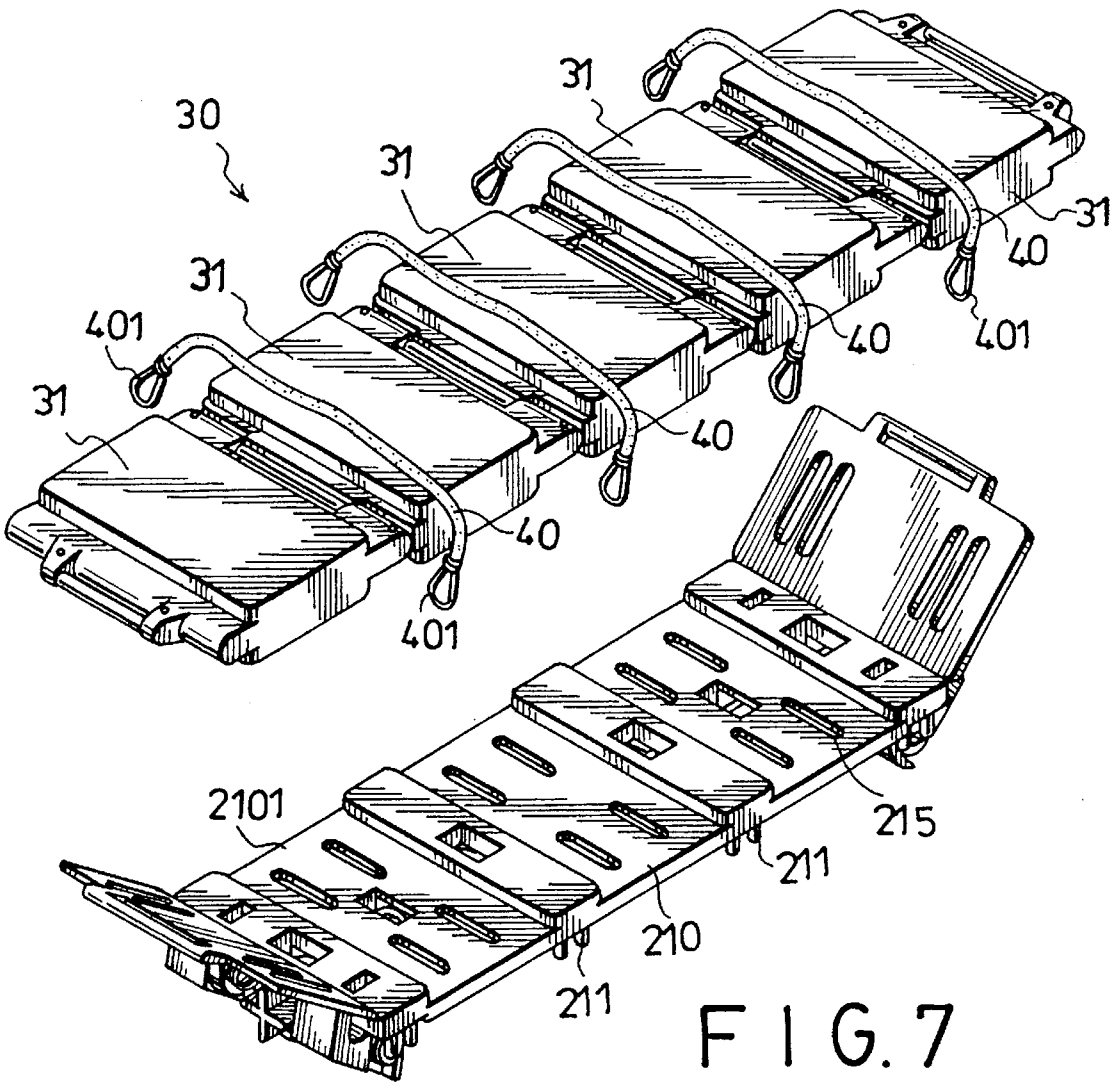
FIG. 7 illustrates a magnetic vibrating belt to be used with an elongated plate of the modular pad assembly of the first embodiment of the present invention.

Referring to FIG. 7, an alternative embodiment of the elongated plate member 210 of the modular pad assembly of this invention is shown. In this embodiment, the elongated plate member 210 has a structure similar to that of the elongated plate member 10 of shown in FIG. 4 except that there are no flaps 20 provided thereon; rather, three equally spaced recessed portions 2101 are formed in the top face of the elongated plate member 210. Each of the recessed portions 2101 has four slots 215 disposed thereon for ventilation purposes. The recessed portions 2101 of the plate member 210 are adapted to receive a plurality of magnetic members 31 of a magnetic vibrating belt 30 containing wires (not shown) which connecting electrically the magnetic members 31 to a power supply (not shown) so as to actuate the magnets to vibrate in order to massage a user's body as described in the prior art. A plurality of elastic cords 40 with two looped ends 401 are retained on the pegs 211 formed on the lower face of plate member 210 so as to secure the magnetic members 31 of the magnetic vibrating belt 30 on the recessed portions 2101 of the plate member 210.

Figure 8:
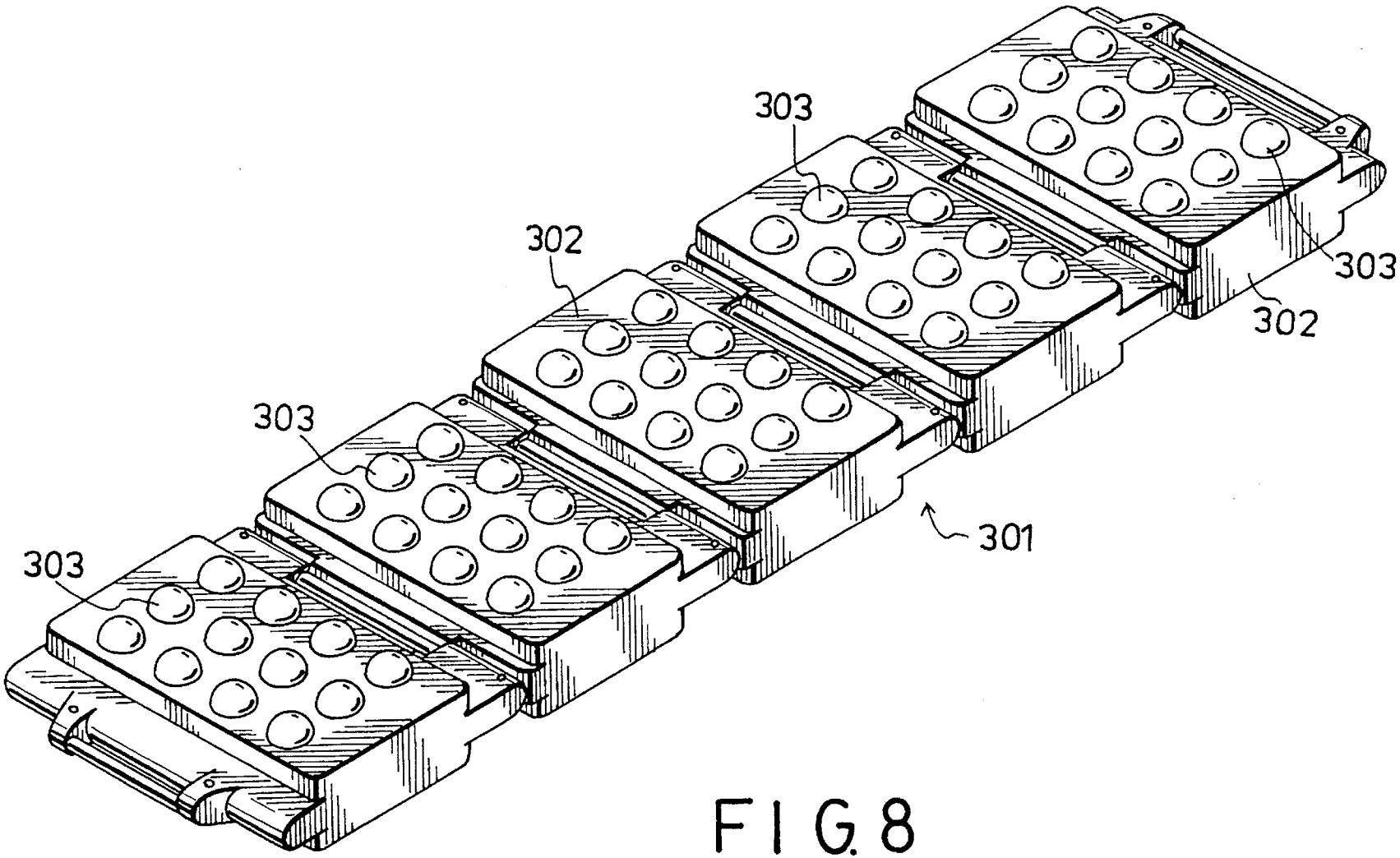
FIG. 8 shows a massaging unit provided on the second embodiment of the present invention.

Referring to FIG. 8, a massaging apparatus 301 can be used with the elongated plate member 210 of the modular pad assembly 100 of this invention instead of the magnetic vibrating belt 30. The massaging apparatus 301 is formed by a plurality of blocks 302 having protrusions 302 formed thereon to effect the massaging purposes.

Figure 9:
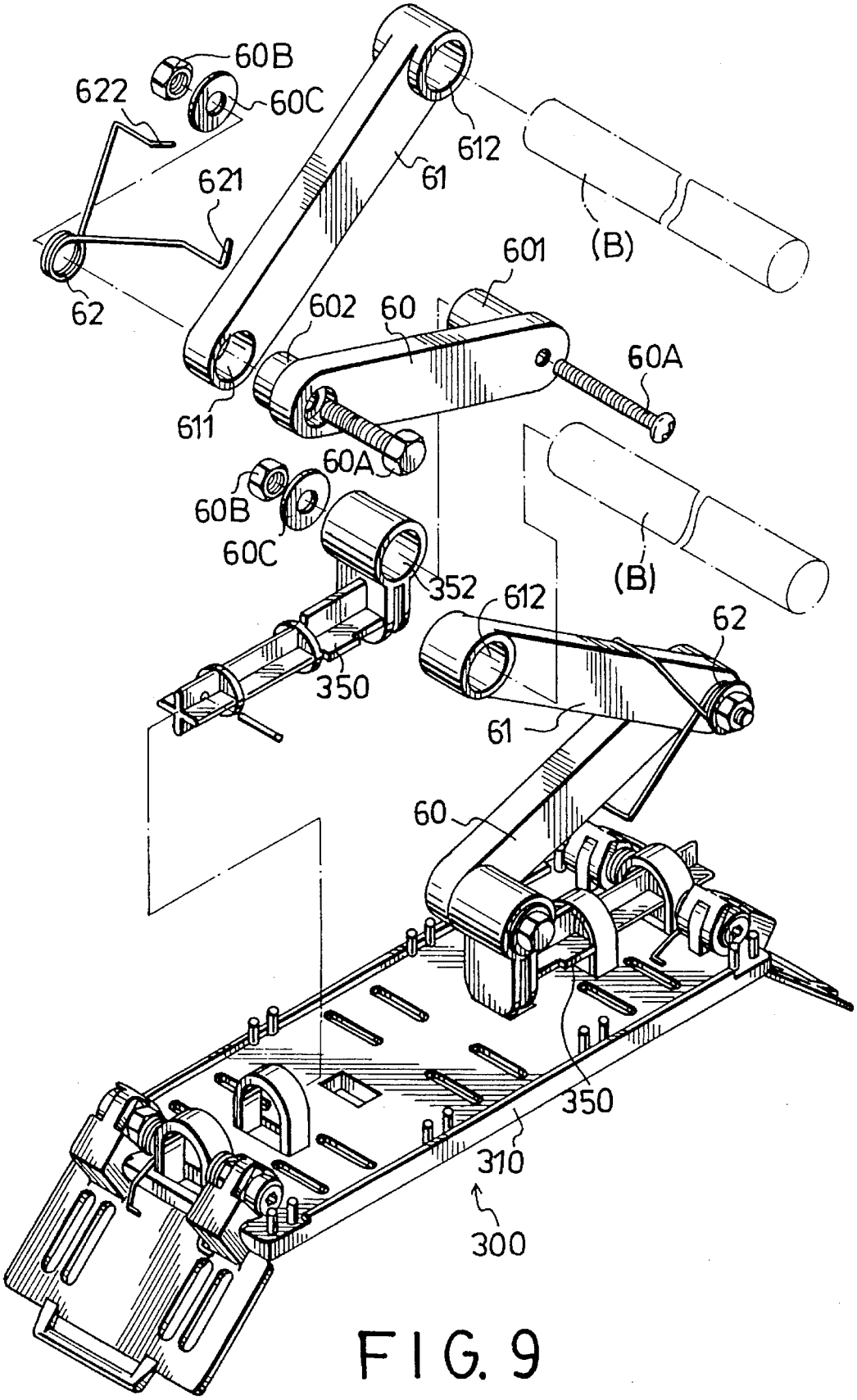
FIG. 9 is an exploded perspective view showing a part of a second preferred embodiment of a modular pad assembly 300 according to the present invention.

FIG. 9 shows a part of a second preferred embodiment of the modular pad assembly 300 according to the present invention. In this embodiment, the structure of the elongated plate member 310 is the same as that of the elongated plate member 10 of the first embodiment. However, the coupling members of the second preferred embodiment is formed of two connecting rods (B), a pair of first linkage rods 60 and a pair of second linkage rods 61 pivotally connected respectively to the first linkage rods 60. Each of the first linkage rods 60 has a first end 601 pivotally connected to one of the connecting loops 352 of the L-shaped support rods 350 and a second end 602. Each of the second linkage rod 61 has a first end 611 pivotally connected to the second end 601 of the first linkage rods 60 via a pivot pin (60A) and a second end having an engaging ring 612 with an axis which is parallel with one of the axes of the connecting loops 352 of the L-shaped support rods 350. Each of the pivot pins (60A) is provided with a torsion spring member 62 which has one end portion 621 engaging the first linkage rod 60 and the other end portion 622 engaging the second linkage rod 61. Each of the pivot pins (60A) passes through one of the second ends 602 of the first linkage rods 60 and through one of the first ends 611 of the second linkage rods 61 to engage the nuts (60B). The first linkage rods 60 can be pivoted resiliently relative to the second linkage rods 61 about the pivot pins (60A) at a predetermined angle. Thus, the distance between the plate member 10 and the connecting rods (B) may be increased by means of the first linkage rod 60 and the second linkage rod 61, as opposed to the first embodiment shown in FIG. 2. Therefore, when the top face 3 of the plate member 10 is depressed, the elongated plate member 310 can be moved resiliently upwardly and downwardly relative to the L-shaped support rods 350, thereby increasing the flexibility of assembly 300 in a vertical direction.

Figure 10:
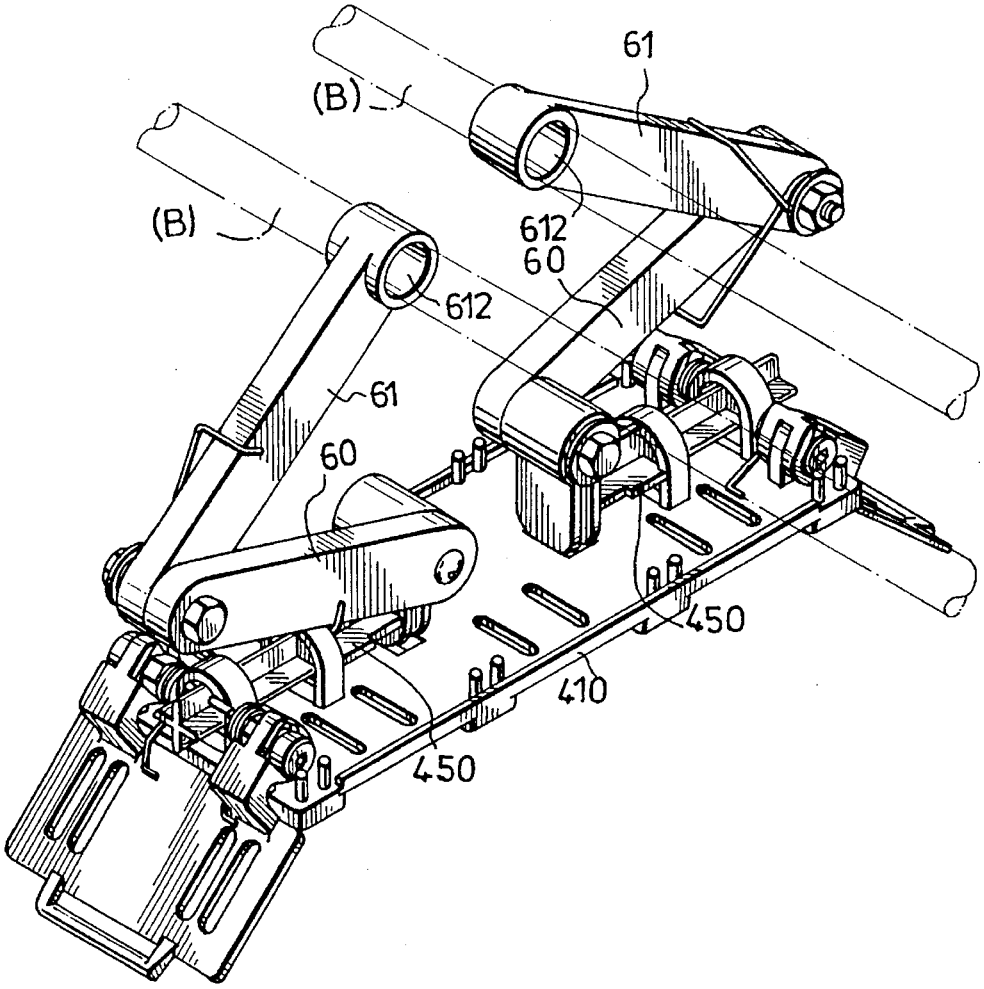
FIG. 10 is a perspective view showing the modular pad assembly according to the second embodiment of the present invention.

Referring to FIG. 10 which shows the elongated plate member 410 of the second preferred embodiment of the modular pad assembly according to this invention. The elongated plate member 410 in this embodiment is the same as that of the elongated plate member 210 of the modular pad assembly of this invention shown in FIG. 7. The elongated plate member 450 of this embodiment can be used with the magnetic member 31 of the vibrating belt 30 shown in FIG. 7 or the massaging unit 301 shown in FIG. 8.

Generally, a conventional rectangular box (not shown) having a top half and a bottom half to cover the user's body is used to effect massaging. Thus, the modular pad assembly of this invention can be applied in a conventional rectangular box. The example is as the following detail.

Figure 11:
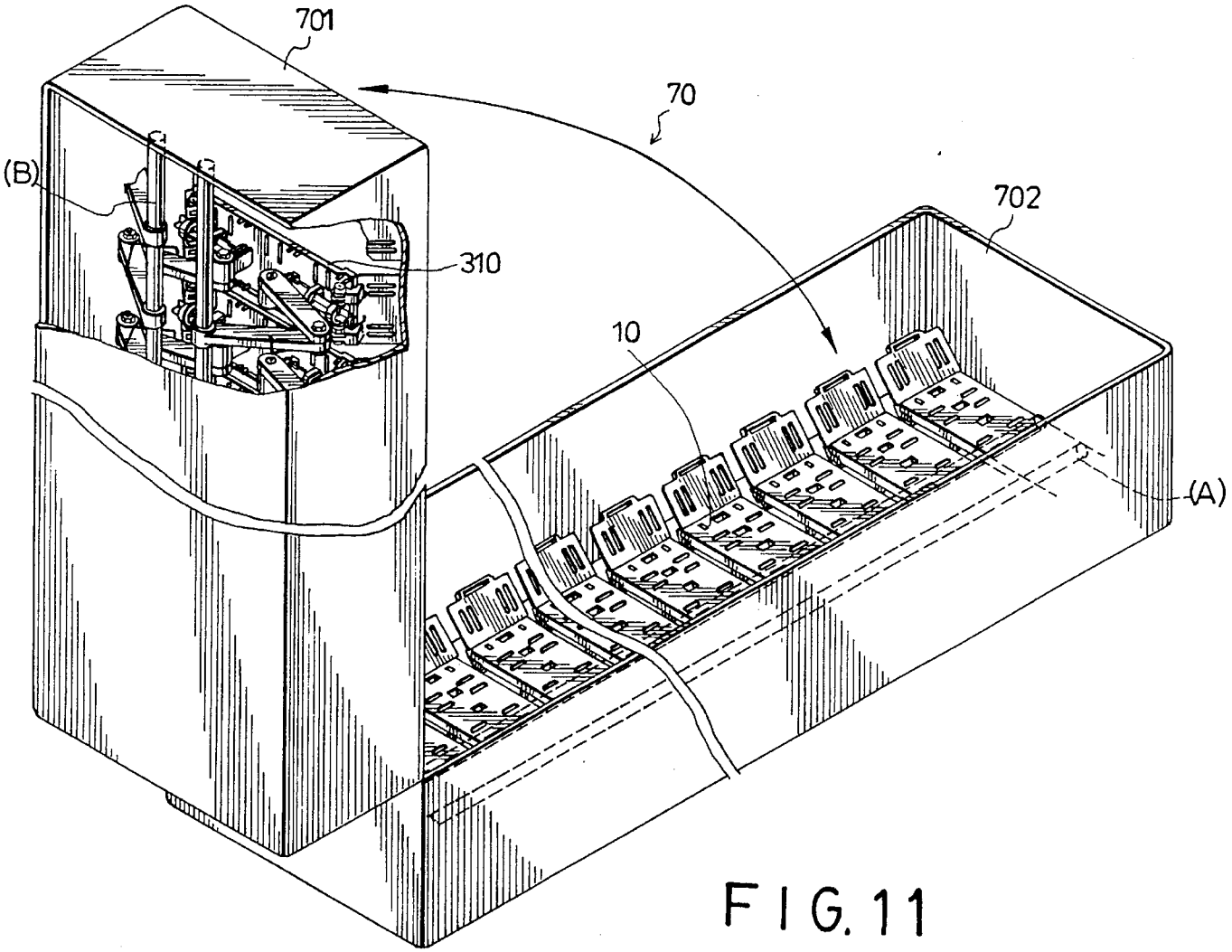
FIG. 11 is a perspective view showing the elongated plate members of the modular pad assemblies with the first and second linkage rods of the coupling member according to the preferred embodiments of the present invention.

As best shown in FIG. 11, the modular pad assemblies 100, 300 of the embodiments of the present invention are provided in a rectangular box 70. The rectangular box 70 is a known apparatus in which the magnetic vibration belts 30 of FIG. 7 or the massaging unit 301 of FIG. 8, are installed in order for massage purposes for remedial or hygienic treatment. The rectangular box 70 has a top half 701 and a bottom half 702 pivotably connected to the top half 701.

When the conventional rectangular box 70 is in half 701 while the front side of the user's body is covered with the massaging units 301 or the magnetic vibrating belts 30 and the top half 701 is disposed on the bottom half 702. After lying for a period of time on the bottom half 702 of the rectangular box 70, a user would begin to feel uncomfortable because the top half 701 and the bottom half 702 of the rectangular box 70 are not conformed to the outline of the human body. The discomfort is worse if the massaging units 301 or the magnetic vibrating belts 30 are mounted on the bottom half of the rectangular box 70 and cover the front side of the user's body because the massaging units 301 and the magnetic vibrating belts 30 in the rectangular box 70 are not designed with ventilating slots therein so that air will not circulate in the rectangular box 70. The above-mentioned disadvantages of the rectangular box 70 can be overcome by providing the modular pad assemblies of this invention.

Referring to FIG. 11, the connecting rods (A) of the modular pad assembly 100 of FIG. 1 are secured longitudinally into the periphery of the frame of the bottom half 702 of the box 70 and a plurality of the elongated plate members 10 of the modular pad assembly 100 of FIG. 1 are mounted to the connecting rods (A) in the bottom half 702 so as to bear against the back of the user's body. In FIG. 1, each of the elongated plate members 10 of the modular pad assembly 100 can be rods 50 so as to correspond the outline of the back of a user's body.

Because the front side of the human body is of a wavier outline than the back of the human body, the top half 701 of the rectangular box 70 has the modular pad assembly 300 shown in FIG. 9 mounted therein. The connecting rods (B) of the modular pad assembly 300 of the FIG. 9 are fixed into the periphery of the frame of the top half 701. A plurality of the elongated plate members 310 of the modular pad assembly 300 are suspended from the connecting rods (B) of the modular pad assembly 300 of the top half 701 of the rectangular box 70 and the top face 3 thereof faces the bottom half 702 of the rectangular box 70. Furthermore, the torsion springs 62 of the first linkage rods 60 and the second linkage rods 61 enable torsion springs 62 to make the linkage rods 60 pivoted resiliently to the linkage rods 61 at a predetermined angle so that the elongated plate members 310 of the modular pad assembly 300 shown in FIG. 9 are more flexible than the elongated plate member 10 of the modular pad assembly 100 shown in FIG. 1 in the vertical direction as to conform to the wavy outline of the front side of the user's body.

Figure 12:
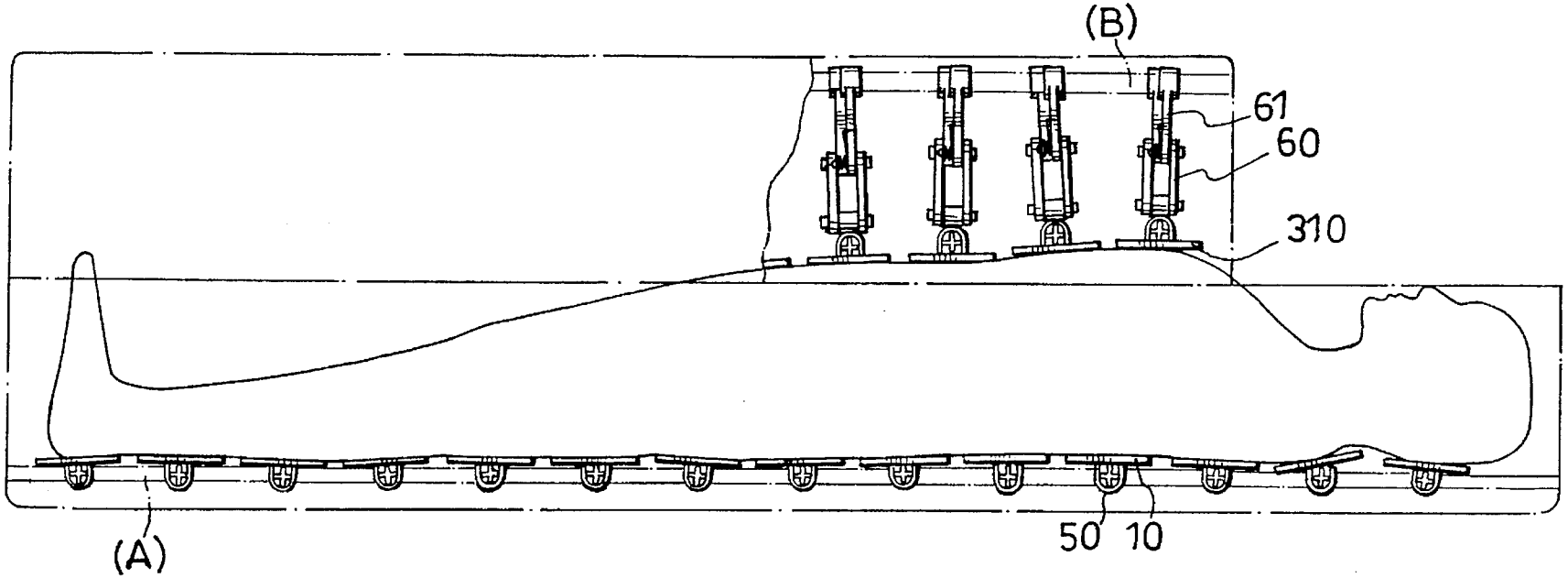
FIG. 12 is a schematic view illustrating the elongated plate members of the modular pad assemblies with the first and second linkage rods of the coupling member according to the preferred embodiments of the present invention.

As best illustrated in FIG. 12, the elongated plate members 10, 310 of the modular pad assemblies 100, 300 in the bottom half 701 and the top half 701 of resiliently upwardly and downwardly to conform to the outlines of the front side of a user's body and are rotated about the L-shaped support rods 50 of the pad assembly 100 to conform to the outline of the back of a user's body compared with the prior art. As shown in FIG. 9, the elongated plate member 310 of the modular pad assembly is the same as FIG. 7. The recessed portions 2101 of the plate member 210 shown in FIG. 7 are adapted to receive a plurality of magnetic members 31 in order to massage a user's body as described in the prior art.

A plurality of elastic cords 40 (see FIG. 7) with two looped ends 401 are retained on the pegs 211 formed on the lower face of plate member 210 so as to secure the magnetic members 31 of the magnetic vibrating belt 30 on the recessed portions 2101 of the plate member 210.

In addition, the slots of the elongated plate member of the modular pad assembly of this invention assist in air circulation between the rectangular box when in use.

The above-mentioned modular pad assemblies of the preferred embodiments of the present invention are not only applicable to chairs and the rectangular massage box, but can also be mounted on various lying and sitting devices, for example, a bed or a lawn chair. Furthermore, the modular pad assemblies 100, 300 of this invention provided better ventilation and is prior art. In addition, each of the elongated plate members 10, 310 divides the outline of the user's body into several sections for a fine adjustment of the pad assembly on which the user is to lie or sit.

While the present invention has been described in connection with what is considered the most practical and preferred embodiments, it is understood that this invention is not limited to the disclosed embodiment but is intended to cover various arrangements included within the spirit and scope of the broadest interpretations and equivalent arrangements.

I claim:

1. A modular pad assembly comprising:

at least two elongated plate members, each having a longitudinal axis, each of said plate members having two opposed ends, and upper and lower faces, each of said lower faces of said elongated plate members having two longitudinally spaced retaining rings formed thereon, said two retaining rings each having an axis and being aligned with one another and being parallel with the longitudinal axis of one of the elongated plate members, each of said retaining rings of said elongated plate member having an L-shaped support rod mounted rotatably thereto, each of said L-shaped support rods having a first arm which is journalled to the respective one of the retaining rings and a second arm which is connected perpendicularly to said first arm of said L-shaped support rod, each of said second arms of said L-shaped support rods having a free end which is formed with a connecting loop, each of said connecting loops of said L-shaped support rods having an axis transverse to the longitudinal axis of one of said elongated plates, the axes of said connecting loops adjacent ones of said opposed ends of said elongated plate members being aligned with one another to form a first common axis while the axes of said connecting loops adjacent the other ones of said opposed ends of said elongated plate members are aligned with one another to form a second common axis, said first and second common axis being on a first plane parallel with a second plane defined by the respective one of said elongated plates, each of said L-shaped support rods having two positioning members , connected near both sides of one of said retaining rings to prevent said first arm of said L-shaped rod from being disengaged from said retaining rings, each of said elongated plate members having a pair of coupling members interconnecting said connecting loops along said first and second common axis, respectively.

2. A modular pad assembly as claimed in claim 1, wherein each of said coupling members includes a connecting rod (A) which passes through said connecting loops of said L-shaped support rods of said elongated plates located along one of said first and second common axes.

3. A modular pad assembly as claimed in claim 1, wherein each of said coupling members includes a first linkage rod having a first end pivotally connected to one of the connecting loops of the L-shaped support rods and a second end, a second linkage rod having a first end pivotally connected to said second end of said first linkage rod at a pivot pin and a second end having an engaging ring with an axis which is parallel with one of said axes of said connecting loops of said L-shaped support rods , and a torsional spring member provided at one of said pivot pin to permit said first and second linkage rods to be pivoted with respect to said coupling members further including a connecting rod which passes through said connecting loops of said L-shaped support rods of said elongated plate members located along one of said first and second common axes.

4. A modular pad assembly as claimed in claim 1, wherein each of said elongated plate members has a pair of flaps hinged respectively to said opposed ends of said elongated plate members about two pivot points, respectively, each of said pivot points having a torsion spring provided thereto, each of said torsion spring members urging one of the flaps upwardly to form an angle with respect to one of said upper faces of said elongated plate members.

5. A modular pad assembly as claimed in claim 1, wherein each of said elongated plate members has a plurality slots formed therein.

6. A modular pad assembly as claimed in claim 1, wherein each of said elongated plate members has a plurality of equally spaced recessed portions which are adapted to receive a plurality of magnetic members of a magnetic vibrating belt.

7. A modular pad assembly as claimed in claim 6 further including a plurality of elastic cords with two looped ends, wherein each of said elongated plate members has a plurality of pegs depending from one of the lower faces of said elongated plate members.

* * * * *